US009725877B2

(12) United States Patent
Norman

(10) Patent No.: US 9,725,877 B2
(45) Date of Patent: Aug. 8, 2017

(54) UNDERWATER TRENCHING APPARATUS

(71) Applicant: Bryan A. Norman, Maurice, LA (US)

(72) Inventor: Bryan A. Norman, Maurice, LA (US)

( * ) Notice: Subject to any disclaimer, the term of this patent is extended or adjusted under 35 U.S.C. 154(b) by 120 days.

(21) Appl. No.: 14/810,563

(22) Filed: Jul. 28, 2015

(65) Prior Publication Data

US 2017/0030050 A1 Feb. 2, 2017

(51) Int. Cl.
*E02F 5/00* (2006.01)
*E02F 5/10* (2006.01)

(52) U.S. Cl.
CPC ..... *E02F 5/107* (2013.01); *E02F 5/006* (2013.01)

(58) Field of Classification Search
CPC ..... E02F 3/9206; E02F 5/107; E02F 5/006
See application file for complete search history.

(56) References Cited

U.S. PATENT DOCUMENTS 2,956,354 A * 10/1960 Varner ..... E02F 3/925 37/323
3,877,237 A * 4/1975 Norman ..... E02F 5/105 405/160
4,087,981 A * 5/1978 Norman ..... E02F 5/105 37/335
4,280,289 A * 7/1981 Bassompierre-Sewrin ..... E02F 3/9206 104/118
4,295,757 A * 10/1981 Gaspar ..... E02F 5/104 405/163
4,389,139 A * 6/1983 Norman ..... E02F 5/107 405/161
4,586,850 A 5/1986 Norman et al.
5,288,172 A * 2/1994 Reuhl ..... E02B 3/023 37/344
5,944,447 A * 8/1999 Wyatt ..... E02F 3/9206 37/323
6,273,642 B1 8/2001 Anderson
6,705,029 B2 3/2004 Anderson
6,719,494 B1 * 4/2004 Machin ..... E02F 3/9206 37/344

FOREIGN PATENT DOCUMENTS

GB 1316481 A * 5/1973 ..... E02F 3/9206

* cited by examiner

*Primary Examiner* — Benjamin Fiorello
(74) *Attorney, Agent, or Firm* — Vorys, Sater, Seymour and Pease LLP

(57) ABSTRACT

An apparatus for forming a trench along the bed of a body of water for burying a line lying along such bed including a support structure designed to straddle such line, means for propelling such structure straddling such line and means disposed on such structure including a pair of transversely spaced excavator devices cooperable in forming a trench along the bed of such body of water for receiving such line, each provided with a set of circumferentially spaced, pressurized fluid ejecting nozzles, rotatable about an axis.

34 Claims, 5 Drawing Sheets

UNDERWATER TRENCHING APPARATUS

This invention relates to an apparatus for forming a trench along the bed of a body of water and more particularly to such an apparatus functional to form such a trench more effectively, expeditiously and at various selected depths and widths.

BACKGROUND OF THE INVENTION

In the prior art, there have been developed and used a number of apparatuses for forming trenches along the bed of a body of water for burying various transmission lines lying along such a bed. Examples of such apparatuses are disclosed in U.S. Pat. No. 4,586,850 to Robert M. Norman and Franklin C. Wade, U.S. Pat. No. 6,273,642 to Richard A. Anderson and U.S. Pat. No. 6,705,029 to Richard A. Anderson. Although such machines have performed well in burying pipelines, it has been found that such types of machines can be improved upon to expand upon their capabilities. Accordingly, it is the principal object of the present invention to provide an improved apparatus for burying lengths of pipelines and the like lying along the bed of a body of water. Another object of the invention is to provide an apparatus for more expediently and effectively displacing soil beneath a pipeline lying along a water bed, allowing such pipeline to descend into a trench being formed and become buried. A still further object of the invention is to provide such a machine adjustable configuratively to form trenches in water beds of different depths and/or widths accommodating the burial of pipelines of various sizes. Another object of the invention is to provide such an apparatus capable of improved propulsion capability thereby improving productivity.

SUMMARY OF THE INVENTION

The objects of the invention are achieved by an apparatus including a support structure having a longitudinally disposed recess in the lower end thereof for straddling a pipeline lying along a water bed; means mounted on such structure, engageable with a segment of the line received within such recess; for propelling such structure along such line and means disposed on such structure including a pair of transversely spaced excavator devices functional in forming a trench along the bed of such body of water, each provided with a set of circumferentially spaced, pressurized fluid ejecting nozzles rotatable about an axis. Each of such excavator devices is mounted on a fluid supply component of the support structure, connected to a source of fluid under pressure, for rotation about an axis disposed downwardly and outwardly relative to the support structure, with the set of nozzles thereof spaced circumferentially in a plane disposed normal to the axis thereof, communicable with such component, with each of the nozzles being angularly disposed relative to such plane, an increased degree relative to the degree of angularity of a successive nozzle. In the preferred embodiment of the invention, each half of the circumference in such plane of the device is provided with a spaced set of nozzles, progressively increasingly angled relative to such plane.

DETAILED DESCRIPTION OF THE PREFERRED EMBODIMENTS OF THE INVENTION

Figure 1:
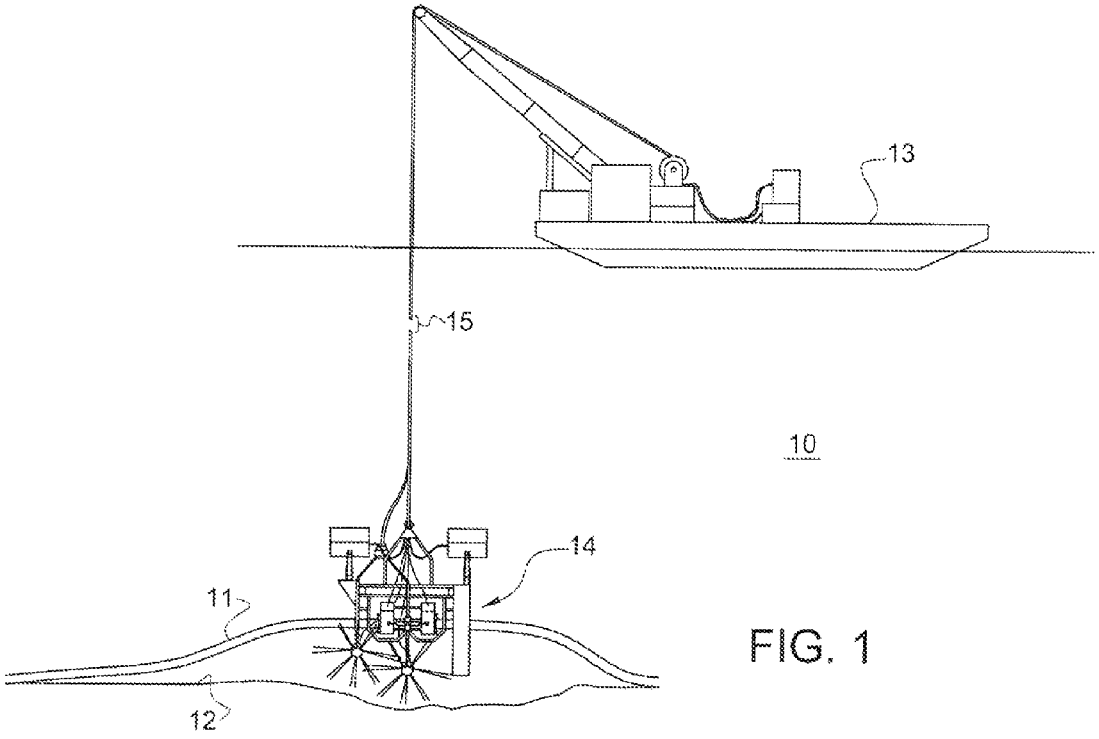
FIG. 1 is a view of an apparatus embodying the present invention, having been lowered into a body of water by equipment mounted on a service barge, and positioned in straddling relation relative to a pipeline lying along the bed of such body of water.
Figure 2:
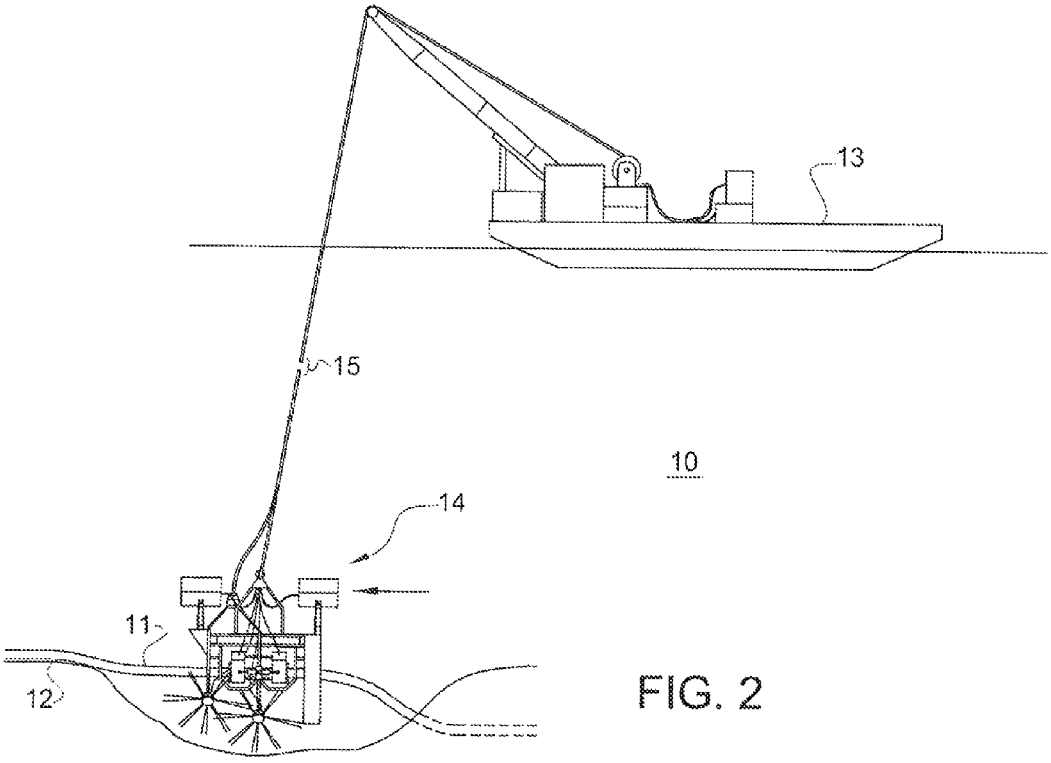
FIG. 2 is a view similar to the view shown in FIG. 1, illustrating the apparatus being propelled along such pipeline.
Figure 3:
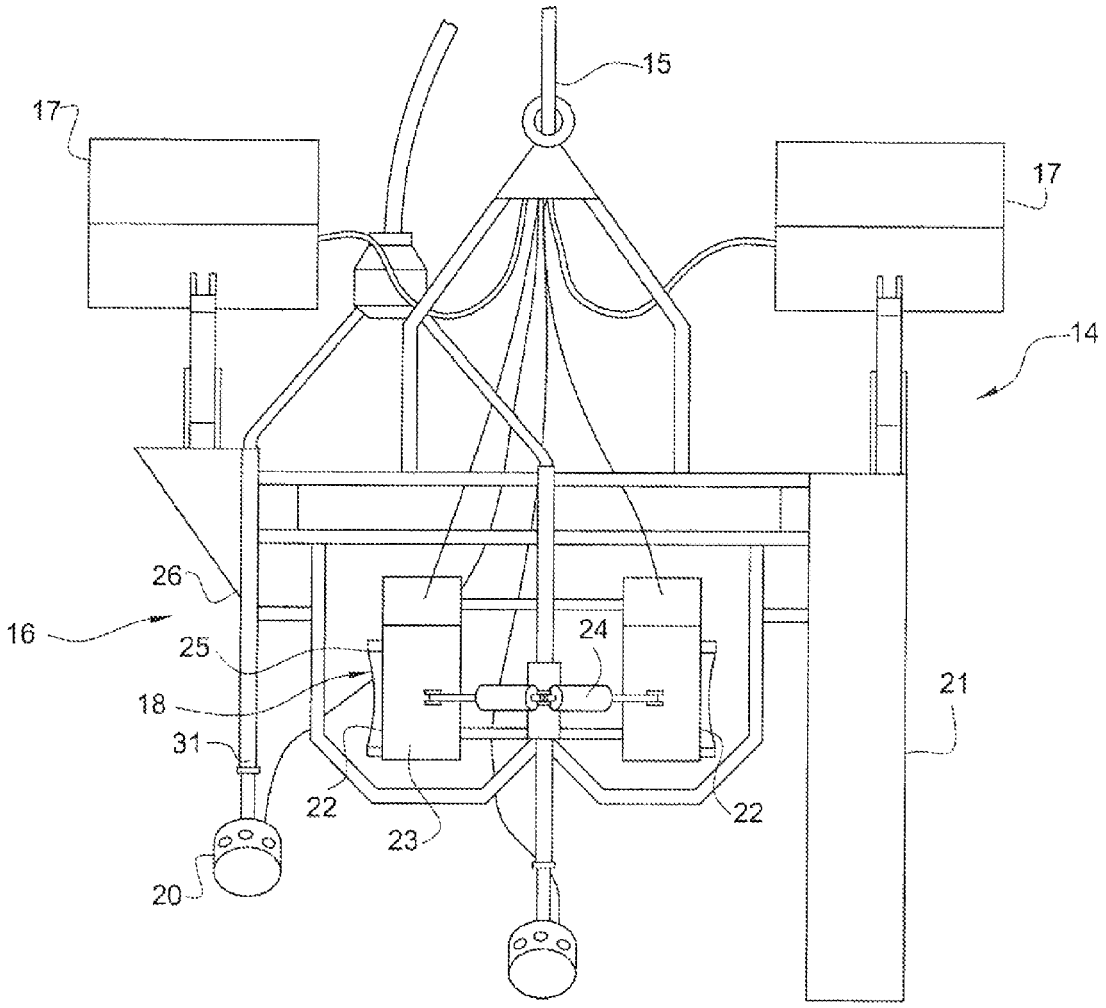
FIG. 3 is an enlarged side view of the apparatus shown in FIGS. 1 and 2.

Referring to FIGS. 1 through 3 of the drawings, there is shown a body of water 10, a pipeline 11 lying along the bed 12 of the body of water, a service barge 13 stationed on the body of water above or in proximity of such pipeline, a trenching apparatus 14 embodying the present invention and a service line 15 extending from the service barge to the trenching apparatus for lowering and lifting the apparatus and supporting and guiding various lines for conveying water, air and hydraulic fluid under pressure from pumps and compressors mounted on the barge to the trenching apparatus. The apparatus further is provided with a winch apparatus for lowering the trenching apparatus to the water bed straddling the pipeline to the buried and lifting it for relocation and storage purposes.

Figure 4:
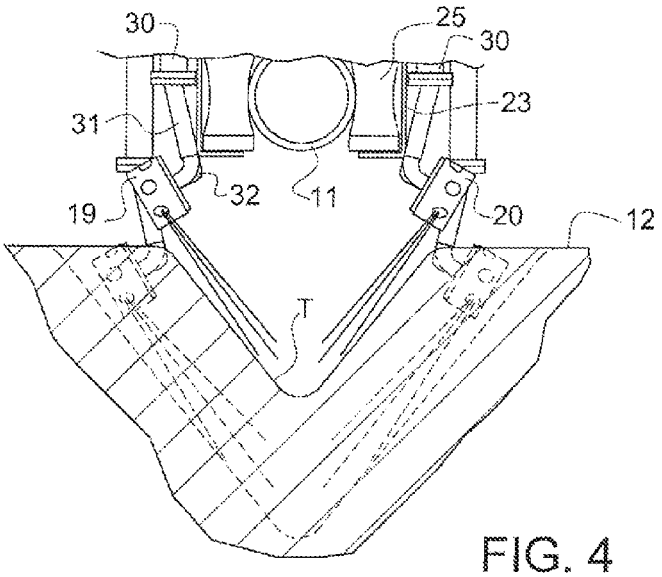
FIG. 4 is a partial front view of the apparatus shown in FIG. 3, illustrating the manner of operation of the apparatus in forming a trench for burying the pipeline shown in FIGS. 1 and 2.

As best shown in FIGS. 3 and 4, trenching apparatus 14 includes a support structure 16 provided with a longitudinally disposed recess in the bottom side thereof, a set of buoyancy tanks 17, an apparatus propelling assembly 18, two pairs of excavator devices 19 and 20 and a set of loose soil eductors 21, 21. Buoyancy tanks 17 are mounted on the upper side of the support structure which may consist of single or pairs of tanks disposed forwardly and rearwardly with each of such tanks being provided with fluid conveyer lines operatively connected to a compressor provided on the service barge. Such tanks and the control systems thereof would be operated in the conventional manner to lower and lift the apparatus through the body of water. Propulsion assembly 18 consists of a pair of longitudinally spaced, drivable roller assemblies 22, 22, each supported on the support structure aside the longitudinal pipeline receiving recess. Each roller assembly is provided with a carrier 23 supported on the rod portion of a cylinder assembly 24 having the cylinder portion thereof connected to a member of the support structure, and a roller 25 provided with a vertical shaft journalled at a lower end thereof in a lower portion of the carrier, and connected at an upper end thereof to a hydraulic motor 26 also supported on carrier 23. Adjacent or remote means are provided to operate cylinder assembly 24 to selectively displace the roller into and out of pressing engagement with a pipeline segment extending through the structure recess, and further means are provided for supplying fluid under pressure from a compressor mounted on the service barge to motors 26 to cause all of such rollers pressed against such segment and rotated, to advance the apparatus along the pipeline straddled by the apparatus. As best shown in FIG. 4, a pair of laterally spaced conduits 30, 30 are mounted on the front end of the support structure, each provided with an intermediate section 31 and a continuous end section 32 provided with an axis extending outwardly and downwardly, on which one of excavator devises 19 and 20 is mounted for rotation about such axis.

Figure 5:
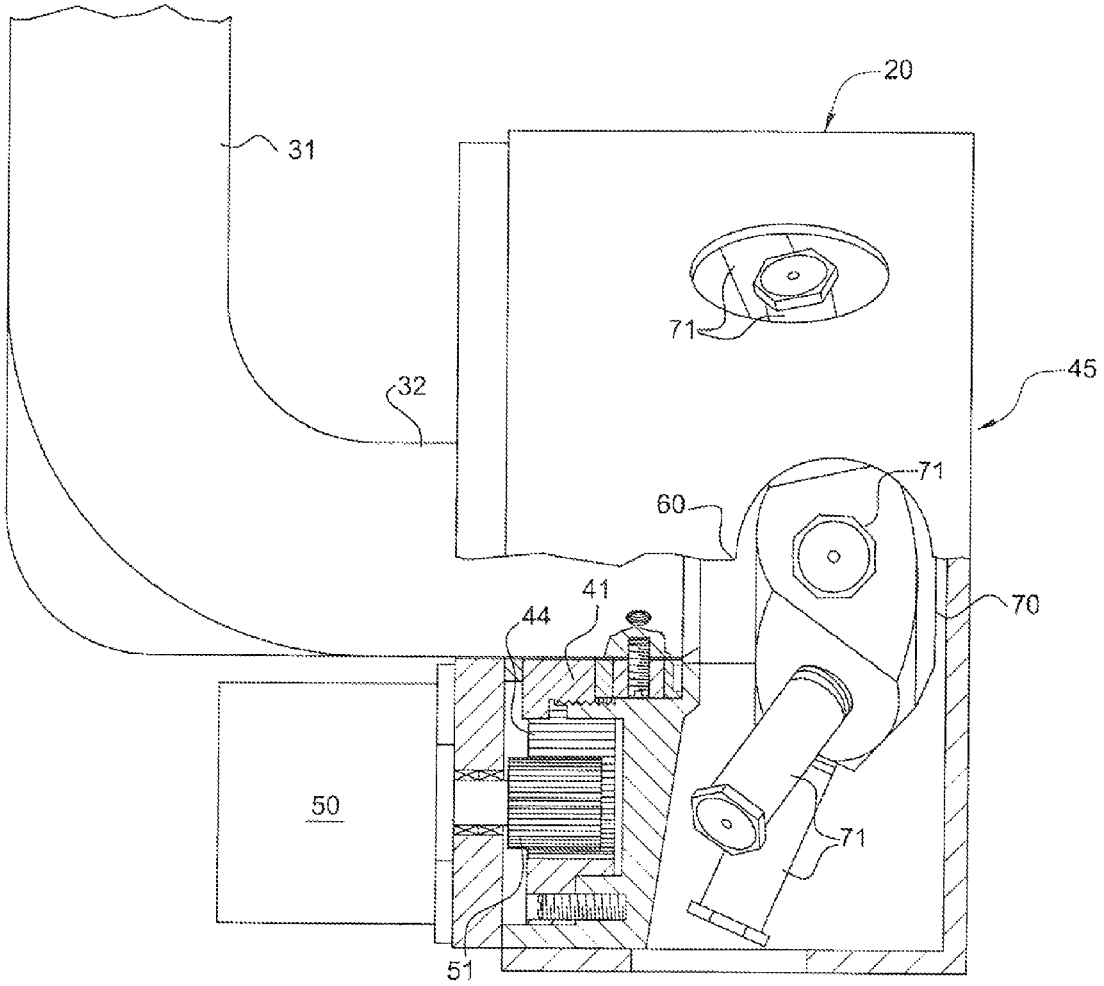
FIG. 5 is an enlarged side view of an excavator device of the apparatus shown in FIGS. 1 through 4 illustrating an exposed portion in partial cross section.
Figure 6:
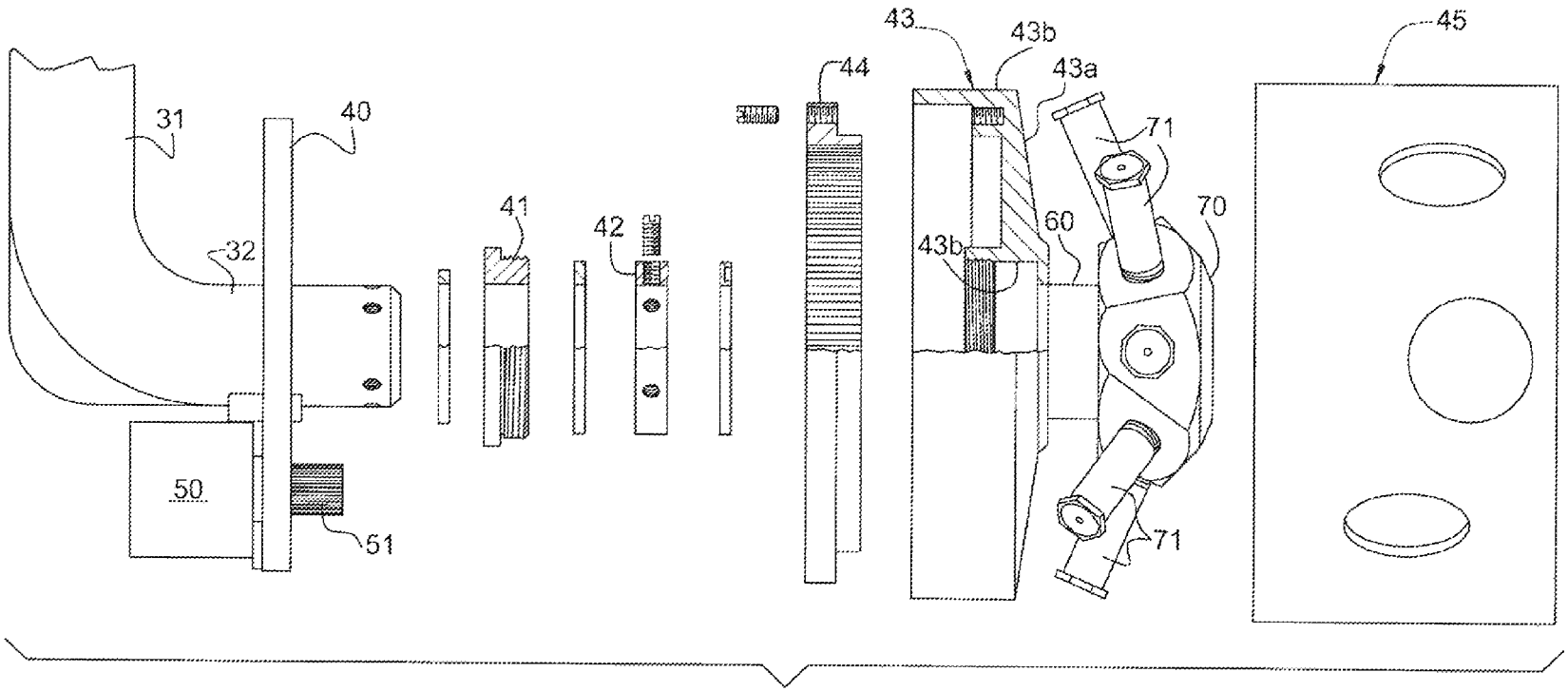
FIG. 6 is an exploded view of the excavator device shown in FIG. 5, depicting the components thereof in exploded relation.

FIGS. 5 and 6 illustrate the construction of each of devices 19 and 20 with the components thereof disposed in assembled and spaced relation. The device includes a mounting plate 40, an externally threaded lock nut 41, a locking ring 42, an internal housing 43, an internal ring gear 44 and an outer housing 45. Plate 40 is annularly configured, displaced from the end of conduit end section 32, rigidly secured thereto and positioned in a plane disposed at a normal angle relative to the axis of such end section. Disposed radially of the axis of conduit section 32 and mounted on plate 40 is a hydraulic motor 50 provided with an output shaft extending through an opening in plate 40, having a pinion gear 51 mounted thereon. Lock nut 41 is rotatably mounted on conduit end section 32 and axially restricted thereon by locking ring 42 mounted on the end of section 32 and secured thereto by means of a threaded bolt. A pair of gaskets further is provided on conduit section 32 to allow lock nut 41 to rotate freely.

Internal housing 43 includes an annular wall section 43*a* provided with an axially disposed opening 43*b*, and an integral cylindrical wall section 43*c*. An inner end of axial opening 43*b* is threaded allowing internal housing 43 to be threaded onto lock nut 41 when rotatably mounted on conduit end section 32 and secured thereon by locking ring 42. Internally threaded gear 44 is inserted coaxially in internal housing 43 and secured to annular wall section 43*a* by means of threaded fasteners. Housing 43 further is provided with a conduit 60 rigidly mounted on annular wall section 43*a* and coaxially disposed relative to opening 43*b*, and a nozzle holder 70 provided with a plurality of outlets evenly spaced circumferentially in a plane disposed normal to the axis of internal housing 43, and communicating with the interior of conduit 60 and axial opening 43*b* in housing 43. Such outlets are angularly disposed to one side of the plane in which they are circumferentially spaced with the degree of angularity of the nozzles disposed in each half of such circumference being disposed in progressively increasing degrees. In the preferred embodiment, such progressively disposed nozzles on each half of such circumference are disposed successively at angles of 0, 12, 24 and 34 degrees.

The components illustrated in FIG. 6 are assembled as shown in FIG. 5 to provide each of assembled excavator devices 19 and 20 as shown in FIGS. 3 and 4. In particular, lock nut 41 is rotatably mounted on conduit end section 32 with a pair of gaskets provided on each side thereof, and locking ring 42 is then mounted on such conduit section and firmly secured thereto by a threaded member to preclude axial displacement of the lock nut. Ring gear 44 is then inserted in housing 43 and secured coaxially to annular wall section 43*a*, and housing 43 with ring gear 44 and nozzle holder 70 firmly and coaxially mounted thereon, is threaded onto the threaded portion of lock nut 41. As housing 43 is thus threaded onto lock nut 41, the annular edge of cylindrical wall section 43*b* will be disposed adjacent mounting plate 40, pinion gear 51 will mesh with internal ring gear 44, as shown in FIG. 5, and fluid under pressure supplied through conduit 31 will be cause to flow axially through conduit end 32, passageway 43*b* in housing 43, conduit 60 and nozzle holder 70 to be ejected through nozzles 71 in highly pressurized jet streams. Such assembly of components further is encompassed by outer housing 45 provided with a set of circumferentially spaced openings to accommodate therethrough the extension of nozzles 71.

With excavator devices 19 and 20 transversely spaced and oriented as shown in FIG. 4, supports structure 16 mounted in straddling relation to the pipeline as shown in FIGS. 3 and 4, and advanced along the pipeline, fluid under pressure supplied to such devices and the inner housings of such devices rotating under high speed, the nozzles of such devices will eject jets of high speed fluid in a set of planes disposed at increased angles relative to the plane disposed normal to the axis of each device, penetrating the soil bed along the longitudinal direction of movement of the apparatus. Such operation and movement of such devices will cause the penetration of such planes of high speed jets to loosen and displace inwardly increasing strata of bed soil, forming a trench T provided with V-shaped cross sectional configuration as shown in FIG. 4. Such loosened and inwardly displaced soil is caused to be entrained in swirling streams of water, forming a slurry which is caused to be drawn through inlets of rearwardly disposed eductors 21, 21, conducted upperwardly and discharged laterally or rearwardly. As such a trench is formed, the loosened soil is removed and the apparatus moves forwardly, segments of the pipeline are caused to drop therein an eventually become buried by bed soil displaced by water currents.

Figure 7:
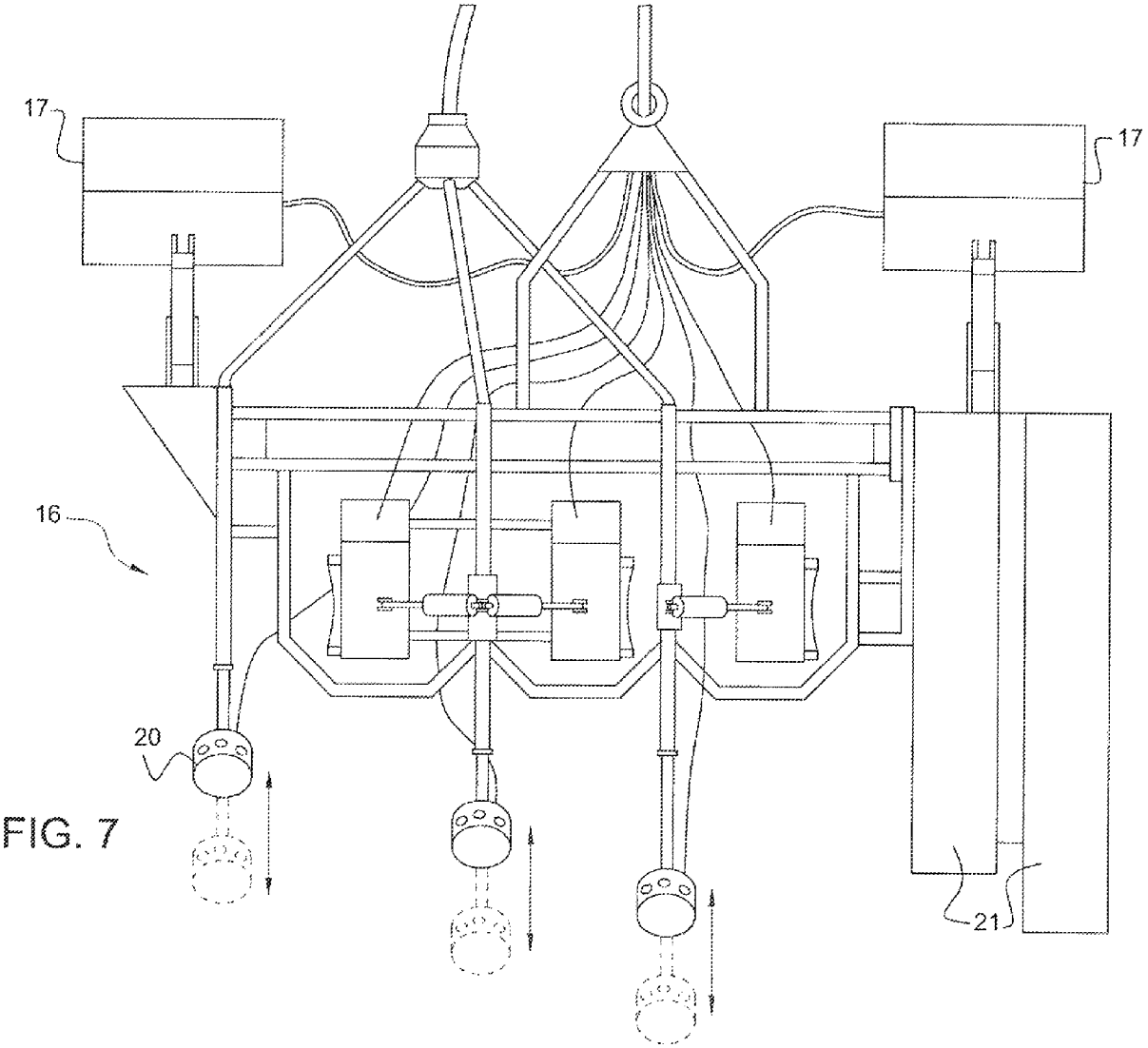
FIG. 7 is a side view of another embodiment of the invention.

The apparatus as described may be equipped with a single pair of transversely spaced and oriented excavator devices as described, two pairs of such devices as shown in FIG. 3 and four pairs thereof as shown in FIG. 7, depending on the size of the pipeline to be buried. In the embodiment in which two successive sets of excavator devices are used, the second pair of such devices is oriented in the same manner as the first pair of devices, and are more transversely spaced apart and disposed deeper than the first pair of devices, as shown in FIGS. 3 and 4. In the embodiment in which three successive sets of excavator devices are used the second pair of devices, oriented in the same manner as the first set of devices, are more transversely spaced apart and deeper than the first set of devices, and the third pair of devices, are oriented in the same manner as the first and second pairs of devices, and are more transversely spaced apart and deeper than the second set of devices, to form wider and deeper trenches for accommodating pipelines of even greater diameters.

The means for mounting the excavator devices on the support structure of the apparatus is structured and functional to permit a variation of the transverse spacing of the devices of each pair thereof and a variation of the vertical positioning of each pair of devices, allowing greater forms of usage of the apparatus. As depicted in FIGS. 3 and 7, and particularly as illustrated through the use of dashed lines in FIG. 7 to indicate multiple configurations, the conduits 31 are repositionable with respect to the support structure 16, thereby allowing for variation in the vertical positioning of the evacuator devices 20.

Typically, the apparatus as described, configured to accommodate the burying of a pipeline of a particular size, is mounted on a service barge, transported to a site disposed above the pipeline lying along the bed of the body of water, and lowered and positioned in straddling relation relative to the pipeline as shown in FIGS. 1 and 2. With such apparatus thus lowered and positioned, the drive motors of assemblies 23, 23 are activated and hydraulic cylinders 24, 24 are extended to cause rollers 25 to firmly engage the adjacent pipeline segment and rotate to propel the apparatus along the length the pipeline. As the apparatus thus proceeds along the pipeline, fluid under pressure is supplied to the selectively mounted excavator devices and ejected at high pressure to form a trench as previously described. Simultaneously, a negative pressure applied to the eductors functions to draw and expel in laterally or aft directions the slurry of loosened soil and water formed in the course of the excavating process.

In each of the excavator devices as described, the circumferential displacement of the nozzles in a plane disposed perpendicularly relative to the axis of rotation thereof, the angularity of such nozzles to a single side of such plane and the successive increase in angularity of the nozzles on each half of such circumference provides upon the rotation of such nozzles of the ejection of streams of fluid under high pressure therefrom, forming planes of ejected fluid which function to penetrate, loosen and displace strata of bed soil, causing such soil to form a slurry with a turbulent water to be drawn into an ejected by trailing eductors.

The invention as described provides an apparatus which be may differently configured and operated to effectively and efficiently form differently configured trenches along the bed of a body of water for burying pipelines of various sizes lying along such water bed From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

I claim:

1. An apparatus for forming a trench along the bed of a body of water for burying a line lying along said bed, comprising:

a support structure provided with a longitudinally recessed along a bottom side thereof for receiving a segment of said line therethrough in straddling relation;

means mounted on said support structure engageable with a segment of said line received within said recess for propelling said support structure along said line; and means disposed on said support structure including a pair of transversely spaced excavator devices cooperable in forming a trench along the bed of said body of water, each provided with a set of circumferentially spaced, pressurized fluid ejecting nozzles, rotatable about an axis, wherein each of said excavator devices is mounted on an end portion of a fluid supply component of said support structure connected to a source of fluid under pressure, for rotation about an axis disposed downwardly and outwardly relative to said support structure, including said nozzles spaced circumferentially in a plane disposed normal to said axis, communicable with said component, with each of said nozzles being angularly disposed in one direction relative to one side of said plane, a degree different than the degree of angularity of each successive nozzle.

2. The apparatus of claim 1 wherein said excavator devices each comprise spaced sets of said nozzles that are disposed around half of said circumference of said plane.

3. The apparatus of claim 2 wherein said nozzles are equally spaced apart about said circumference.

4. The apparatus of claim 2 wherein said nozzles within each spaced set are progressively increased in angle relative to said plane.

5. The apparatus of claim 2 wherein said nozzles within each spaced set are progressively angled at 0°, 12°, 24° and 34° relative to said plane.

6. The apparatus of claim 1 wherein said excavator device includes a body provided with a cylindrical segment rotatably mountable on said end portion of said fluid supply component provided with an axial passageway, and a head segment provided with a set of circumferentially spaced openings for mounting said nozzles communicating with said axial passageway and means supported on said fluid supply component and operatively connected to said body for rotation of said body about the axis thereof.

7. The apparatus according to claim 6 wherein said fluid supply component is provided with a mounting plate, said body is provided with a portion including an internal ring gear and a remotely operable motor mounted on an exterior of said mounting plate, provided with an output shaft extending through an opening in said mounting plate, having mounted thereon a pinion gear meshing with said ring gear.

8. The apparatus according to claim 7 including a housing provided with a circular end portion and a cylindrical portion encompassing said body, having spaced openings aligned with said nozzles and disposed adjacent said mounting plate.

9. The apparatus of claim 1 wherein said fluid supply components supporting said pair of excavator devices comprise conduits that are repositionable with respect to said support structure, thereby allowing adjustment of said devices vertically.

10. The apparatus of claim 1 including a second set of said fluid supply components supporting a second pair of said excavator devices, aft and operationally at a lower level of said first pair of excavator devices.

11. The apparatus of claim 10 wherein said second set of fluid supply components supporting said second pair of excavator devices are comprise conduits that are repositionable with respect to said support structure, thereby allowing adjustment of said second pair of excavating devices vertically.

12. The apparatus of claim 10 including a third set of said fluid supply components supporting a third pair of said excavator devices, aft and operationally at a lower level than the level of said second pair of excavator device.

13. The apparatus of claim 12 wherein said third set of fluid supply component supporting said third pair of excavator devices comprise conduits that are repositionable with respect to said support structure, thereby allowing adjustment of said third pair of excavator devices vertically.

14. The apparatus of claim 1 including at least one set of rollers supported on said support structure on each side of said recess therethrough for receiving said line segments therein, hydraulic cylinders that selectively urge said rollers into gripping engagement with a line segment disposed in said recess and rotate said rollers for advancing said apparatus along said line, allowing such excavator device to form a trench and permitting successive segments of said line to gravity fall into said formed trench.

15. The apparatus of claim 1 including eductor devices supported on said support structure, provided with inlets aligned longitudinally aft of an excavator devices.

16. The apparatus of claim 1 including at least one buoyancy tank mounted on said support structure operable in assisting the lowering and lifting of said apparatus.

17. The apparatus of claim 1 including a service line interconnecting a service barge on the surface of said body of water and said apparatus for conveying water, air and hydraulic fluid under pressure from pumps and compressors on said barge to service the operating components of said apparatus including the motors of the rollers functional to advance the apparatus, the motors for the excavator devices, the buoyancy tanks and the eductors.

18. The apparatus of claim 17 wherein said service line is reeved on a pulley mounted on a boom provided on said service barge and operatively connected to pumps and compressors provided thereon.

19. An excavator device operatively mountable on the support structure of an apparatus for forming a trench along the bed of a body of water, connectable on a linear end of a conduit supported on said structure, communicable with a source of fluid under pressure, comprising:

a body rotatably mounted on said conduit end, provided with an axial passageway communicating with said conduit end, and a set of connected passageways having outlets spaced circumferentially in a plane disposed perpendicular to said axis;

a set of nozzles disposed in said set of passageways, projecting through said outlets; and means supported on said conduit, operatively connected to said body for rotating said body about said axis, wherein each of said nozzles are angularly disposed in one direction relative to said plane, a degree different than the degree of angularly of adjacent nozzles.

20. The excavator device of claim 19 wherein said excavator devices each comprise spaced sets of said nozzles that are disposed around half of said circumference of said plane.

21. The excavator device of claim 20 wherein said nozzles are equally spaced about said circumference.

22. The excavator device of claim 20 wherein said nozzles within each spaced set are progressively increased in angle relative to said plane.

23. The excavator device of claim 22 wherein said nozzles within each spaced set are progressively angled at 0°, 12°, 24° and 34° relative to said plane.

24. The excavator device of claim 19 wherein said body is provided with a cylindrical segment rotatably mountable on said fluid supply component, provided with an axial passageway, and a head segment provided with a set of circumferentially spaced openings for mounting said nozzles communicating with said axial passageways and means supported on said fluid supply component and operatively connected to said body for rotation of said body about the axis thereof.

25. The excavator device of claim 24 wherein said fluid supply conduit is provided with a mounting plate, said body is provided with a portion including an internal ring gear and a remotely operable motor is mounted on said mounting plate, provided with an output shaft having a pinion gear meshing with said ring gear.

26. The excavator device of claim 25 including a housing provided with a circular end portion and a cylindrical portion encompassing said body, having spaced openings aligned with said nozzles and disposed adjacent said mounting plate.

27. An excavator device operatively mountable on the support structure of an apparatus for forming a trench along the bed of a body of water, connectable to a linear end portion of a conduit supported on said structure and communicable with a source of fluid under pressure, comprising:

a mounting plate mounted on said conduit end portion spaced from an end thereof and disposed normally relative to the axis thereof, a housing provided with an end wall having an annular opening for rotatably mounting said housing on said conduit end portion and a peripheral wall provided with an internal ring gear disposed coaxially with said conduit end portion;

a motor connectable to an energy source mounted on said mounting plate, having an output shaft extending through an opening in said plate, supporting a pinion meshing with said internal gear, a conduit mounted on said end wall of said housing, coaxially with said end wall opening thereof and said conduit end and communicating with said conduit end;

a nozzle holder mounted on said housing mounted conduit, provided with an axially disposed passageway end a plurality of outwardly directed passageways having outlets circumferentially spaced in a plane disposed normal to said axis; and a plurality of nozzles disposed in said outwardly directed passageways, projecting through outlets thereof, wherein each of said plurality of nozzles are angularly disposed in one direction relative to said plane.

28. The excavator device of claim 27 wherein said excavator devices each comprise spaced sets of said nozzles that are disposed around each half of said plane are progressively increased in angle relative to said plane.

29. The excavator device of claim 28 wherein said nozzles are equally spaced about said circumference.

30. The excavator device of claim 28 wherein said nozzles within each of said spaced sets are progressive angled at 0°, 12°, 24° and 34°.

31. The excavator device of claim 30 wherein said nozzles are equally spaced about said circumferences.

32. An excavator device operatively mountable on the support structure of an apparatus for forming a trench along the bed of a body of water, connectable on a linear end of a conduit supported on said structure, communicable with a source of fluid under pressure, comprising:

a body rotatably mounted on said conduit end, provided with an axial passageway communicating with said conduit end, and a set of connected passageways having outlets spaced circumferentially in a plane disposed perpendicular to said axis, wherein:

said body is provided with a cylindrical segment rotatably mountable on said fluid supply component, provided with an axial passageway, and a head segment provided with a set of circumferentially spaced openings for mounting said nozzles communicating with said axial passageways and means supported on said fluid supply component and operatively connected to said body for rotation of said body about the axis thereof; and said fluid supply conduit is provided with a mounting plate, said body is provided with a portion including an internal ring gear and a remotely operable motor is mounted on said mounting plate, provided with an output shaft having a pinion gear meshing with said ring gear;

a set of nozzles disposed in said set of passageways, projecting through said outlets; and means supported on said conduit, operatively connected to said body for rotating said body about said axis, wherein each of said nozzles are angularly disposed relative to said plane, a degree different than the degree of angularly of adjacent nozzles.

33. The excavator device of claim 32, including a housing provided with a circular end portion and a cylindrical portion encompassing said body, having spaced openings aligned with said nozzles and disposed adjacent said mounting plate.

34. The excavator device of claim 32 wherein said excavator devices each comprise spaced sets of said nozzles that are disposed around each half of said plane are progressively increased in angle relative to said plane.

* * * * *